US009162244B2

(12) United States Patent
Kah, Jr.

(10) Patent No.: US 9,162,244 B2
(45) Date of Patent: Oct. 20, 2015

(54) SPRINKLER BODY INSERTABLE CHECK VALVE TO PREVENT DOWNHILL DRAINAGE

(76) Inventor: Carl L. C. Kah, Jr., North Palm Beach, FL (US)

( * ) Notice: Subject to any disclaimer, the term of this patent is extended or adjusted under 35 U.S.C. 154(b) by 1111 days.

(21) Appl. No.: 11/496,113

(22) Filed: Jul. 31, 2006

(65) Prior Publication Data

US 2007/0034711 A1 Feb. 15, 2007

Related U.S. Application Data

(60) Provisional application No. 60/703,792, filed on Jul. 29, 2005.

(51) Int. Cl.
*B05B 15/10* (2006.01)
*B05B 1/30* (2006.01)

(52) U.S. Cl.
CPC ..... *B05B 15/10* (2013.01); *B05B 1/3006* (2013.01); *B05B 1/3033* (2013.01)

(58) Field of Classification Search
CPC ..... B05B 1/3033; B05B 1/3006; B05B 15/10
USPC ..... 137/541, 542; 239/200–206, 570–572
See application file for complete search history.

(56) References Cited

U.S. PATENT DOCUMENTS

| | | | | | |
|---|---|---|---|---|---|
| 1,260,663 | A * | 3/1918 | Gould, et al. | ..... | 137/541 |
| 2,155,124 | A * | 4/1939 | Gibbons | ..... | 137/541 |
| 2,591,060 | A * | 4/1952 | Garretson | ..... | 137/513.3 |
| 2,821,991 | A * | 2/1958 | Marx | ..... | 137/73 |
| 4,825,897 | A * | 5/1989 | Shade | ..... | 137/271 |
| 5,465,752 | A * | 11/1995 | Higgins | ..... | 137/512.5 |
| 6,695,007 | B2 * | 2/2004 | Vicars | ..... | 137/541 |

* cited by examiner

*Primary Examiner* — Jason Boeckmann
(74) *Attorney, Agent, or Firm* — Ostrolenk Faber LLP

(57) ABSTRACT

A check valve for a sprinkler in accordance with an embodiment of the present application includes a valve body adapted to be positioned at an inlet of the sprinkler, wherein the valve body includes a central opening through which water flows into the sprinkler, a rib extending downwardly from the valve body at a location beyond the margin of the central opening, a valve member configured to cooperate with the central opening to open and close the valve. The valve member includes a valve stem extending downwardly from the valve member, and positioned and configured to be movably supported in a guide ring formed at a lower end of the rib, wherein the valve stem is movable vertically to move the valve member to its open and closed positions. The check valve further include a resilient member biasing the valve stem such that the valve member remains in the closed position until water pressure pushing against the valve member overcomes the bias of the resilient member.

15 Claims, 3 Drawing Sheets

SPRINKLER BODY INSERTABLE CHECK VALVE TO PREVENT DOWNHILL DRAINAGE

CROSS REFERENCE TO RELATED APPLICATIONS

The present application claims the benefit of and priority to U.S. Provisional Patent Application No. 60/703,792 filed Jul. 29, 2005 entitled SPRINKLER BODY INSERTABLE CHECK VALVE TO PREVENT DOWNHILL DRAINAGE, the entire contents of which are hereby incorporated by reference herein.

BACKGROUND OF THE INVENTION

The present invention relates to sprinklers for use in irrigation systems. More specifically, the present application relates to a check valve operable to prevent uphill sprinkler pipes in the irrigation system from draining through a sprinkler or sprinklers positioned at lower terrain elevations.

DESCRIPTION OF THE ART

Sprinklers in an irrigation system are customarily interconnected by a common supply pipe. However, where the sprinklers in the system are positioned at different relative elevations, after the main valve that controls the supply of water to the system is turned off, the water in the uphill portion of the supply pipe near the uphill sprinklers will tend to be drawn downhill by gravity and drain through one or more downhill sprinklers, which is undesirable. For example, such drainage may cause puddles will develop in the area of these sprinklers which may cause damage to the lawn. Further, as discussed in further detail below, the riser may not seat properly back in the body of the sprinkler when the water supply is shut off until the uphill gravity head of water has leaked out the lower sprinklers and reduced the sprinkler house pressure sufficiently so that the riser retraction spring can fully retract the riser.

Sprinklers are known which incorporate some type of check valve that closes and shuts off the flow of water when the pressure in the line drops below a certain level in order to limit the downhill runoff of water from the uphill sprinklers that are connected to the same line. In some cases, the sprinkler riser is fitted with a rubber valving plug member in its bottom end which can shut off against a sealing ridge around the inlet to the sprinkler body with the sprinkler riser retraction spring providing the force to close the valve at the bottom of the sprinkler body against the water head pressure created by the uphill supply line water. Some examples of sprinklers using this construction are shown in U.S. Pat. Nos. 4,892,252, 5,765,757 and 4,353,507, for example. Alternatively, a separate check valve may be incorporated into the supply pipe of the irrigation system to prevent unwanted drainage through a sprinkler head as is described in U.S. Pat. No. 5,090,446 assigned to Hunter Industries. Examples of such a check valve are HCV check valves sold by Hunter Industries and the ACV series of valves sold by Rainbird.

In the sprinkler with the downhill drainage prevention check valve positioned on the bottom of the riser that uses the downward movement of the riser to shut off the valve, the relatively large diameter of the sprinkler riser and the water pressure on the cross sectional area thereof and the housing seal friction determines the force that the riser retraction spring must overcome before it can retract the riser and seat the drain check valve area at the bottom of the sprinkler at its inlet. The inlet, which is open to the sprinkler body at its bottom is generally smaller in diameter than the riser, so that once the riser is retracted and the plug of the check valve positioned at the bottom of the riser is against the sprinkler body inlet seal ring to close the inlet, it can hold a high head of water from the supply pipe. For example, the plug may resist the pressure of 10 to 20 feet of water in the supply pipe. That is, the plug and riser can resist a fairly substantial amount of pressure once closed, however, because of the larger diameter pressure area, it will not retract until the sprinkler head pressure is less than 5-7 feet of uphill head pressure.

One solution to this problem is to use a heavier riser retraction spring. However, because of the long travel of such retraction springs, which ranges from 2 to 12 inches, the springs are large and add significant additional expense to manufacture of the sprinkler for being able to check against the downhill drainage from higher elevation heads.

Thus, it would be beneficial to provide a check valve which avoids the problems mentioned above.

SUMMARY OF THE INVENTION

It is an object of the present invention to provide a check valve for use in a sprinkler that avoids the problems mentioned above.

The present invention relates generally to a small spring-loaded check valve insert which can be screwed or pressed into the thread inlet of an existing sprinkler body with the spring on the poppet valve pre-compression loaded to open only above a certain pressure level, such as a 5 p.s.i. differential or a 10 p.s.i. differential to provide downhill drainage flow stoppage through the sprinkler of, for example, 11 to 22 feet, respectively. The check valve puts an extra pressure drop in water supply line, however, this is not a problem if the sprinkler is in the lower part of the irrigation system where it will have a higher head pressure due to it lower relative terrain elevation. The check valves may be color coded to allow for selective downhill drainage stoppage for selective sprinklers and is less expensive than having to modify or replace the supply pipelines in the irrigation system to install separate check valve in each pipe such as is disclosed in U.S. Pat. No. 5,090,446. Thus, the sprinkler insertable check valve provides a very easy and cost effective way to provide extra downhill draining stoppage for selective sprinklers as needed.

Alternatively, the valve and support structure may be manufactured into the sprinkler housing during production and the sprinkler housing marked for check elevation capability A check valve in accordance with an embodiment of the present application includes a valve body positioned adjacent to an inlet of the sprinkler, wherein the valve body includes a central opening through which water flows into the sprinkler, a rib extending downwardly from the valve body at a location beyond the margin of the central opening, a valve member configured to cooperate with the central opening to open and close the valve, a valve stem extending downwardly from the valve member, and positioned and configured to be movably supported in a guide ring formed at a lower end of the rib, wherein the valve stem is movable vertically to move the valve member to its open and closed positions and a spring biasing the valve stem such that the valve member remains in the closed position until water pressure pushing against the valve member overcomes the spring bias.

A sprinkler for use in an irrigation system in accordance with an embodiment of the present application includes a body, a riser mounted in the body and operable to move upward and downward therein, an inlet formed in a bottom of the body for connection to a water supply and a check valve positioned in the inlet and operable to move between an open position in which water is supplied to the sprinkler and a closed position in which water is prevented from entering the sprinkler, wherein the check valve is biased in the closed position until a predetermined pressure is applied to the check valve to move it into the open position.

An insertable check valve for insertion into an existing sprinkler assembly to prevent downhill drainage from connected sprinklers at higher elevations in accordance with an embodiment of the present application includes a valve body adapted for insertion at an inlet of the sprinkler, wherein the valve body includes a central opening through which water flows into the sprinkler, a rib extending downwardly from the valve body at a location beyond the margin of the central opening, a valve member configured to cooperate with the central opening to open and close the valve, wherein the valve member includes a valve stem extending downwardly from the valve member, and positioned and configured to be movably supported in a guide ring formed at a lower end of the rib, wherein the valve stem is movable vertically to move the valve member to its open and closed positions and a resilient member biasing the valve stem such that the valve member remains in the closed position until water pressure pushing against the valve member overcomes the bias of the resilient member.

Other features and advantages of the present invention will become apparent from the following description of the invention which refers to the accompanying drawings.

BRIEF DESCRIPTION OF THE DRAWING(S)

DETAILED DESCRIPTION OF PREFERRED EMBODIMENTS OF THE INVENTION

In light of the difficulties described above, the present application relates to a smaller diameter relatively short opening stroke spring loaded check valve that may be incorporated in or added to a sprinkler to prevent drainage through downhill sprinklers from an uphill portion of the supply pipe. As a result, a very cost effective and easy way to provide additional terrain elevation run down prevention for a selective number of sprinklers in specialized field situations is provided instead of having the expense of incorporating large stainless steel expensive springs into all production sprinklers.

More specifically, the present application relates to a small spring-loaded check valve insert which may be screwed or pressed into a threaded inlet of an existing sprinkler body. The spring of the check valve is preferably pre-compression loaded to open only above a certain pressure level. For example the spring may be pre-compressed to open when the pressure differential is 10 p.s.i. which corresponds roughly to a supply pipe with a 22 foot elevation change as noted above. Naturally, the spring may be pre-compressed to any desired pressure level. While slightly more pressure will be needed in the supply pipe to activate the sprinkler when desired, as noted above, this will not present a problem since the downhill sprinklers that will typically include the check valve of the present application generally have more head pressure supplied to them due to their lower terrain elevation which allows the additional force of gravity to increase the head pressure available to them. Thus, the check valve may be added to desired sprinklers without the need to further modify the irrigation system. It is particularly useful that the check valve can be selectively installed in certain sprinklers, since a user can select existing sprinklers that need the added protection of the check valve and incorporate the check valve without further modifications.

The check valve may alternatively be manufactured into the sprinkler housing during production as well. Such sprinklers may include an indication on the sprinkler body that they are intended for use at a relatively lower elevation in any particular irrigation system. The sprinkler may similarly be marked to indicate the specific strength of the spring used therein so that the proper sprinkler can be selected for installation in specific irrigation systems.

Figure 1:
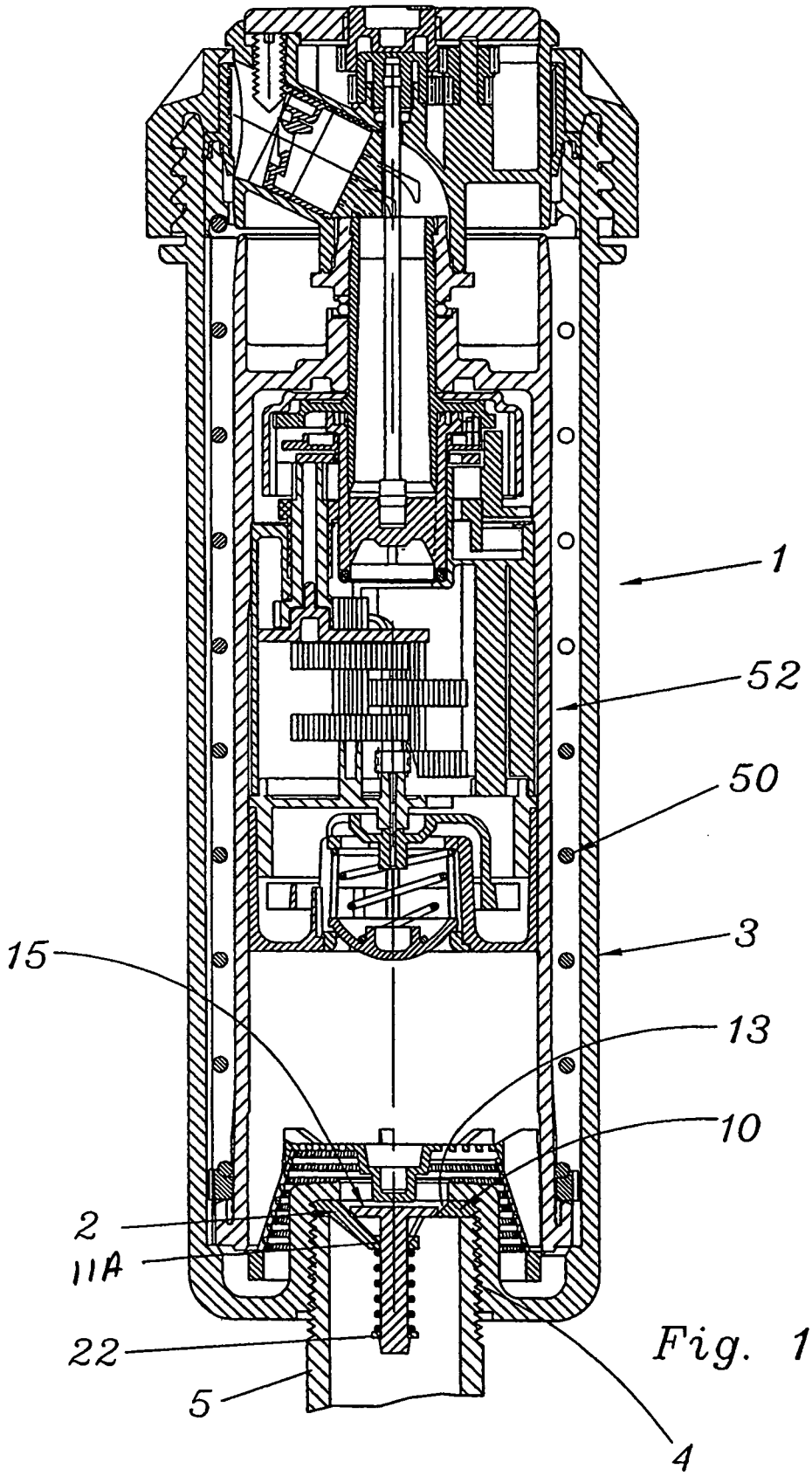
FIG. 1 illustrates a cross section of a sprinkler including a check valve in accordance with an embodiment of the present invention.

Referring to FIG. 1, for example, a pop-up gear driven type sprinkler 1 may include a spring loaded check valve 2 in accordance with the present invention. The check valve 2 of FIG. 1 is shown as a poppet valve but it is to be understood that any other suitable pressure-responsive one-way valve may be used.

Check valve 2 is inserted into the sprinkler body 3 at an inlet threaded area 4 of the sprinkler body before the inlet pipe 5 is screwed into the sprinkler body to supply water to the sprinkler. That is, the check valve 2 is positioned in the threaded area 4 of the sprinkler body 2, between the sprinkler body 3 and the inlet pipe 5.

Figure 2A:
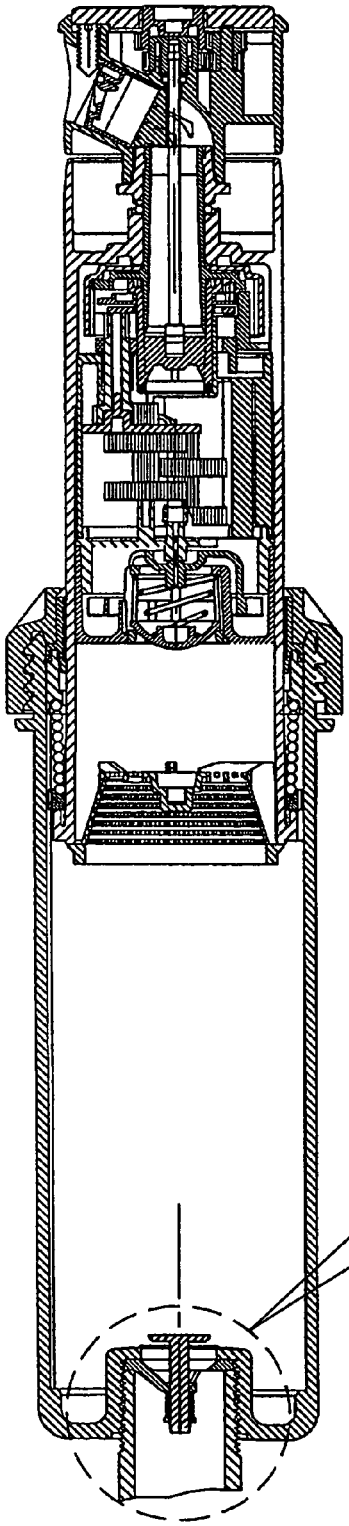
FIG. 2A is an illustration of the sprinkler of FIG. 1 where the riser is in the raised position.
Figure 2B:
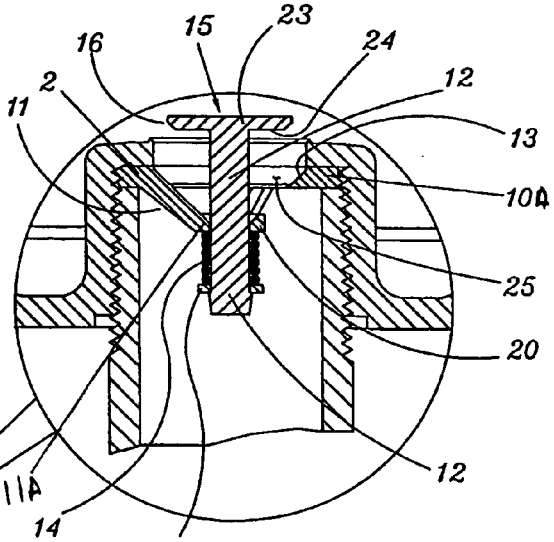
FIG. 2B is an enlarged view of the check valve illustrated in FIG. 1.
Figure 3A:
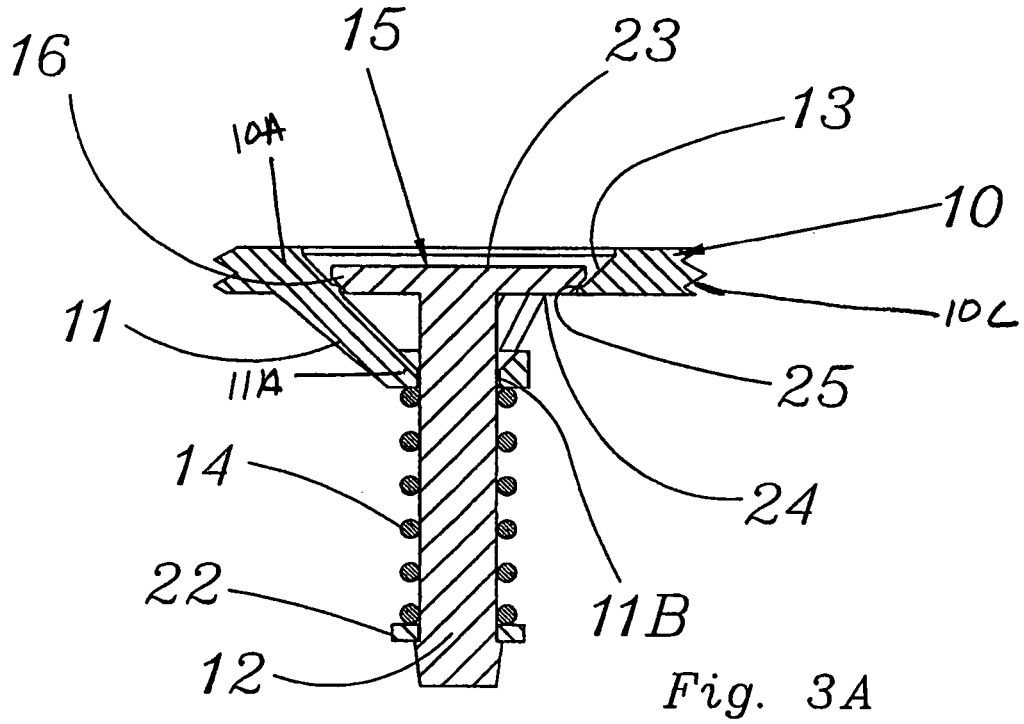
FIG. 3A is an cross-sectional view of the check valve in accordance with an embodiment of the present application.
Figure 3B:
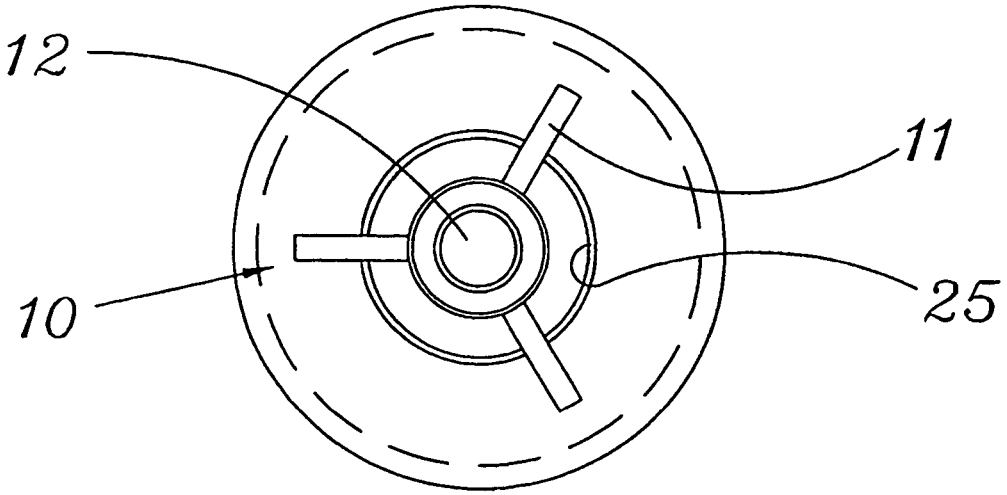
FIG. 3B is a bottom plan view of the check valve of FIG. 3.

As best seen in FIGS. 2B, 3A, and 3B, in the illustrated embodiment, the sprinkler insertable spring loaded check valve 2 preferably includes a body portion 10, a valve member 15 and a compression spring 14. Valve body 10 is formed of an annular washer-like plate 10A with one or more downwardly tapering ribs 11 terminating at their lower ends in a guide ring or flange 11A. In a preferred embodiment, a plurality of ribs 11 extend downwardly and inwardly from the valve body 10 to provide additional support for the guide ring 11A.

Valve member 15 includes a valve disk 23 and a downwardly extending valve stem 12 which is positioned in guide ring 11A. A beveled peripheral edge 16 of disk 23 cooperates with a valve seat formed by complementary surface 13 on the radially inner margin of plate 10A to open and close the valve. Ring 11A guides the vertical movement of valve stem 12 (see FIGS. 2B and 3B).

The top of compression spring 14 bears against the bottom surface 11B of guide ring 11A (see FIG. 3A). The spring 14 is partially compressed upon assembly so the bottom end of the spring 14 rests against a radial flange 22 which is integrally formed with or suitably attached near the lower end of valve stem 12. The downward force of spring 14 against flange 22 forces disk 23 to seal against surface 16, and thereby to close the check valve 2 unless the water pressure exerts a force which overcomes the spring force, as will be appreciated by those skilled in the art. While the present application specifically makes reference to spring 14, it is to be understood that spring 14 may be replaced by any resilient member. Similarly, while the spring 14 is illustrated as a helical spring, any other resilient member may be used, for example a leaf spring.

The opening 25 in annular plate 10A has a pressure area equal to its radius squared times $\pi$. Thus, for example, a ¾ inch diameter hole would have a pressure area of 0.4 and need a spring force of 4 lbs. in order to keep the valve closed in an irrigation system with a 20 foot elevation change. For a ½ inch diameter hole it would require 2 lbs. of spring force to keep the poppet closed for 10 feet of terrain elevation. In contrast, when a riser retraction spring 50 in the sprinkler body 3 is provided to push the riser 52 down against the approximately 10 p.s.i. of pressure that results from 20 feet of terrain elevation, the spring force of spring 50 would have to be 22 lbs. or more, presuming the sprinkler 1 uses a normal riser diameter which is approximately 1.7 to 1.8 inches. The riser typically has a travel distance of 3 to 12 inches in order to ensure that it clears grass or shrubs.

Thus, the insertable check valve 2 described above provides a very cost effective way to prevent drainage due to terrain elevation pressure differentials Check valve 2 is preferably designed for insertion into the threaded section 4 of the body 3 of a conventional sprinkler. The check valve 2 can therefore be installed only in the downhill sprinklers in any irrigation system as necessary.

In a preferred embodiment, the check valve 2 is simply inserted into the threaded section 4 of the body 3 of the sprinkler on top of inlet pipe section 5, and is held in place against the margin of the inlet opening when body 3 is threaded onto pipe section 5. Alternatively the outer margin 10C (see FIG. 3A) of annular plate 10A may be threaded so valve body 10 may also be threaded into the body 3 above inlet pipe section 5. Thus, installation and removal of the valve into selected sprinklers is simple, reliable, and efficient. As noted above, no plumbing changes are required to provide the additional protection of the check valve, in contrast, for example, to the valve disclosed in U.S. Pat. No. 5,090,446 mentioned above.

The check valve 2 may be marked or color coded to indicate the strength of the spring used therein so that the correct check valve can be selected from each sprinkler in the irrigation system. For example, a check valve that is designed for use in an irrigation system with a 20 foot elevation change will be marked in one way or perhaps color coded in a certain way, while a check valve intended for use in an irrigation system with 10 feet of elevation change may be marked or color coated in another way.

In addition, as is mentioned above, the check valve of the present application may be built directly into the sprinkler 1, In this embodiment, the valve body 10 may be incorporated directly into a bottom part of the body 3 of the sprinkler, for example by integrally molding valve body 10 as part of the lower end of the body 3 as the inlet opening. Otherwise the structure of the integral check valve is substantially similar to check valve 2 described above.

In operation, the spring 14 pushes down on flange 22 to bias valve stem 12 downward whereby disk 23 closes off the opening 25 in annular plate 10A. By proper selection of the spring, water under pressure due to an elevation differential is prevented from draining out through the sprinkler. When the water pressure at the inlet pipe 5 exceeds the force of spring 14, i.e., when the water for the system is turned on, spring 14 is compressed and plate 23 lifts off the valve seat 13, allowing water to exit through the sprinkler nozzle. Thus, even where water from a uphill portion of a supply pipe drains downhill and into the inlet 5, for example, of sprinkler 1, the check valve 2 prevents the water from entering the sprinkler as long as the elevation differential pressure does not overcome the force of spring 14. As noted above, different springs may be incorporated into the check valve such that individual check valves are designed to be appropriate for use in different irrigation systems depending on the elevation change therein.

Although the present invention has been described in relation to particular embodiments thereof, many other variations and modifications and other uses will become apparent to those skilled in the art. For example, as noted above, the helical spring discussed above may be replaced by any resilient member such as a leaf spring and the configuration of the valve may be modified accordingly. It is intended therefore, that the present invention be limited not by the specific disclosure herein, but only by the appended claims.

What is claimed is:

1. A check valve for a sprinkler comprising:

a valve body positioned in an inlet of the sprinkler, wherein the valve body includes a central opening through which water flows into the sprinkler;

a rib extending downwardly from the valve body at a location beyond the margin of the central opening;

a valve member configured to cooperate with the central opening to open and close the valve;

wherein the valve member includes a valve stem extending downwardly from the valve member, and positioned and configured to be movably supported in a guide ring formed at a lower end of the rib, wherein the valve stem is movable vertically to move the valve member to its open and closed positions; and a resilient member biasing the valve member such that the valve member remains in the closed position until water pressure pushing against the valve member overcomes the bias of the resilient member, wherein the valve body, rib, valve member and resilient member are configured to fit entirely within the inlet of the sprinkler.

2. The check valve of claim 1, wherein the valve member comprises:

a disk shaped to fit into the central opening in the valve body when the valve member is in the closed position to block the flow of water into the sprinkler; and a flange extending from the valve stem below the guide ring, wherein the resilient member is positioned between the flange and the guide ring to bias the valve member in the closed position.

3. The check valve of claim 1, wherein the resilient member is tensioned to resist compression until a predetermined pressure is exceeded.

4. The check valve of claim 3, further comprising indicia identifying the predetermined pressure required to move the valve member into the open position.

5. The check valve of claim 1, wherein the check valve is screwed into a threaded portion of a sprinkler body.

6. The check valve of claim 1, further comprising a plurality of ribs extending downwardly from the valve body, wherein the plurality of ribs support the guide ring.

7. The check valve of claim 1, wherein the resilient member is selected to provide an appropriate biasing force based on a relative elevation of a sprinkler in which the check valve is used in an irrigation system.

8. The check valve of claim 1, wherein the resilient member is a helical spring.

9. The check valve of claim 1, wherein the resilient member is a helical spring.

10. An insertable check valve for insertion into an existing sprinkler assembly to prevent downhill drainage from connected sprinklers at higher elevations, the insertable check valve comprising:

a valve body positioned in an inlet of the sprinkler, the valve body having a central opening through which water flows into the sprinkler and threads formed on a periphery thereof, the threads configured and operative to cooperate with an internally threaded inlet of the sprinkler such that the valve body is adapted to be screwed into a body of the sprinkler, the valve body further configured to be secured in the internally threaded inlet between the sprinkler and a water supply pipe threaded into the same internally threaded inlet of the sprinkler;

a rib extending downwardly from the valve body at a location beyond the margin of the central opening;

a valve member configured to cooperate with the central opening to open and close the valve;

wherein the valve member includes a valve stem extending downwardly from the valve member, and positioned and configured to be movably supported in a guide ring formed at a lower end of the rib, wherein the valve stem is movable vertically to move the valve member to its open and closed positions; and a resilient member biasing the valve member such that the valve member remains in the closed position until water pressure pushing against the valve member overcomes the bias of the resilient member.

11. The check valve of claim 10, wherein the valve member comprises:

a disk shaped to fit into the central opening in the valve body when the valve member is in the closed position to block the flow of water into the sprinkler; and a flange extending from the valve stem below the guide ring, wherein the resilient member is positioned between the flange and the guide ring to bias the valve member in the closed position.

12. The check valve of claim 10, wherein the resilient member is tensioned to resist compression until a predetermined pressure is exceeded.

13. The check valve of claim 12, further comprising indicia identifying the predetermined pressure required to move the valve member into the open position.

14. The check valve of claim 10 further comprising a plurality of ribs extending downwardly from the valve body, wherein the plurality of ribs support the guide ring.

15. The check valve of claim 10, wherein the resilient member is selected to provide an appropriate biasing force based on an elevation difference between a sprinkler in which the check valve is used in an irrigation system and a sprinkler located at a higher elevation.

* * * * *